US005769164A

United States Patent [19]

Archer

[11] Patent Number: 5,769,164

[45] Date of Patent: Jun. 23, 1998

[54] WELLBORE CLEANING TOOL

[76] Inventor: Larry Dean Archer, 1001 W. Mesquite St., Jacksboro, Tex. 76458

[21] Appl. No.: 783,549

[22] Filed: Jan. 14, 1997

[51] Int. Cl.[6] ..... E21B 21/00

[52] U.S. Cl. ..... 166/222; 166/312; 175/67

[58] Field of Search ..... 166/222, 312, 166/171; 175/67, 393, 340

[56] References Cited

U.S. PATENT DOCUMENTS

| | | | |
|---|---|---|---|
| 1,661,672 | 3/1928 | Morrison . | |
| 1,945,159 | 1/1934 | Pearce . | |
| 1,945,160 | 1/1934 | Pearce . | |
| 2,963,102 | 12/1960 | Smith . | |
| 4,119,160 | 10/1978 | Summers et al. | 175/67 |
| 4,660,773 | 4/1987 | O'Hanlon . | |
| 4,768,709 | 9/1988 | Yie | 175/67 X |
| 4,787,465 | 11/1988 | Dickinson, III et al. | 175/67 X |
| 4,991,667 | 2/1991 | Wilkes, Jr. et al. . | |
| 5,060,725 | 10/1991 | Buell . | |
| 5,135,051 | 8/1992 | Facteau et al. . | |
| 5,165,438 | 11/1992 | Facteau et al. . | |
| 5,228,508 | 7/1993 | Facteau et al. . | |
| 5,697,442 | 12/1997 | Baldridge | 166/222 X |

*Primary Examiner*—Frank Tsay
*Attorney, Agent, or Firm*—Stephen R. Greiner

[57] ABSTRACT

A tool for discharging pressurized fluids into a wellbore at high velocity to clean foreign matter from the wellbore. The tool includes an elongated, cylindrical body having an upper end that is threaded for attachment to a fluid supply conduit and a lower end that is circumferentially tapered to a narrowed, planar surface. A fluid entry channel is located in the upper end of the cylindrical body. In communication with the fluid entry channel are a pair of fluid discharge channels which terminate in a pair of fluid discharge ports. Each of the fluid discharge ports is positioned adjacent the narrowed, planar surface at the lower, circumferentially-tapered end of the cylindrical body.

16 Claims, 2 Drawing Sheets

WELLBORE CLEANING TOOL

FIELD OF THE INVENTION

The present invention relates generally to wells and, more particularly, to apparatus utilizing liquid introduced at the top of a well for cleaning perforations therein.

BACKGROUND OF THE INVENTION

The production of liquid and gaseous hydrocarbons is usually accomplished by means of wellbores penetrating the earth's surface. These wellbores frequently include protective, tubular casing which is cemented adjacent a hydrocarbon productive strata. Perforations are made through the casing and cement to provide a path for hydrocarbons to reach the casing interior. Hydrocarbon fluids entering the casing may be lifted to the surface and sold for profit.

Salt water, present in the hydrocarbon productive strata, is frequently produced with hydrocarbons from a wellbore. Unfortunately, such salt water has limited commercial value and is usually returned to the hydrocarbon productive strata through a disposal well. Like wells productive of hydrocarbons, disposal wells also utilize perforated casing—here to convey the salt water to a designated subsurface strata.

If a perforation becomes blocked by a chemical precipitate or other foreign matter, then the flow of fluids through the perforation will be impaired. It follows that if enough perforations become blocked, then a production or disposal well can be rendered inoperative.

Prior art tools utilizing jetted streams of fluid have been lowered into wellbores in an effort to open blocked perforations. Many of these tools direct their jetted streams radially outward in a manner that tends to drive blockages more deeply into adjacent perforations thereby increasing the damage to the well. These same tools often have a configuration at their lower ends which is predisposed to becoming stuck in a wellbore constriction. With no means to direct the jetted stream downward and disintegrate the constriction, it is often a time-consuming task to free the stuck tool and effectively clean the well.

SUMMARY OF THE INVENTION

In light of the problems associated with the prior art, it is a principal object of the invention to provide a wellbore cleaning tool which discharges pressurized fluids in a downwardly direction and in a turbulent manner so as to generate pressure fluctuations within a wellbore capable of disintegrating material that may be blocking perforations and flushing the debris from the wellbore.

It is another object of the invention to provide a wellbore cleaning tool of the type described with a configuration that inhibits the blockage of fluid discharge ports in the lower end of the tool.

It is an object of the invention to provide improved elements and arrangements thereof in a wellbore cleaning tool for the purposes described which is uncomplicated in construction, inexpensive in manufacture, and fully effective in use.

Briefly, the wellbore cleaning tool in accordance with this invention achieves the intended objects by featuring an elongated, cylindrical body having an upper end that is threaded for attachment to a fluid supply conduit, such as a string of tubing, and a lower end that is circumferentially tapered to a narrowed, planar surface. A fluid entry channel is located in the upper end of the cylindrical body. In communication with the fluid entry channel are a pair of fluid discharge channels which terminate in a pair of fluid discharge ports. Each of the fluid discharge ports is positioned adjacent the narrowed, planar surface at the lower end of the cylindrical body.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
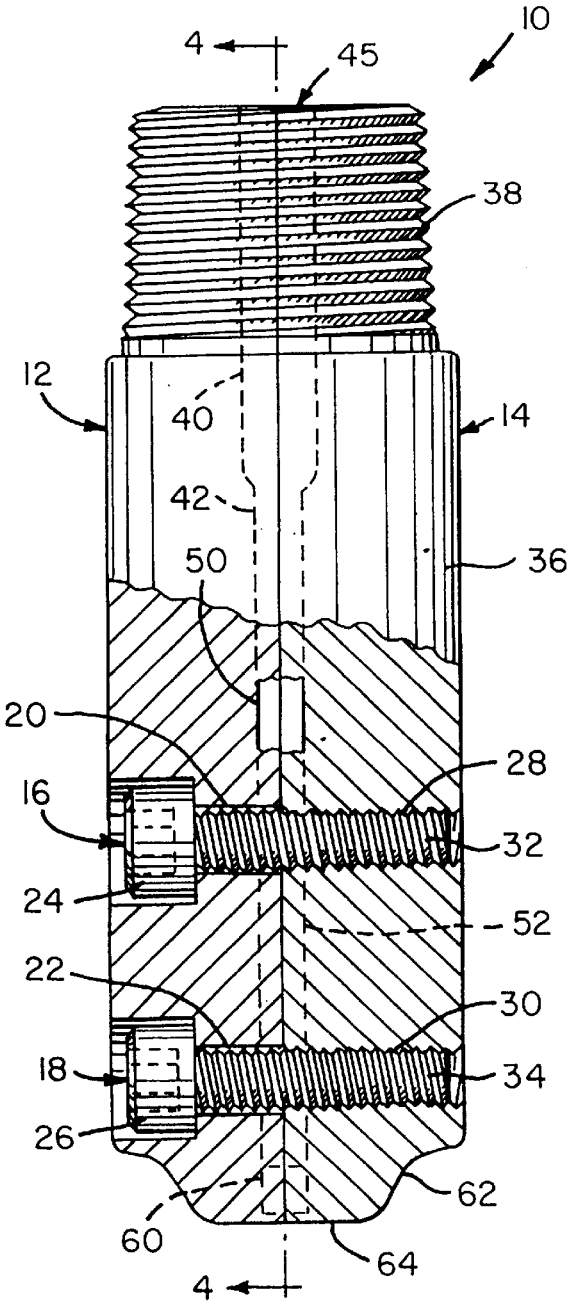
FIG. 1 is a side view of a wellbore cleaning tool in accordance with the present invention having portions broken away to reveal details thereof.
Figure 2:
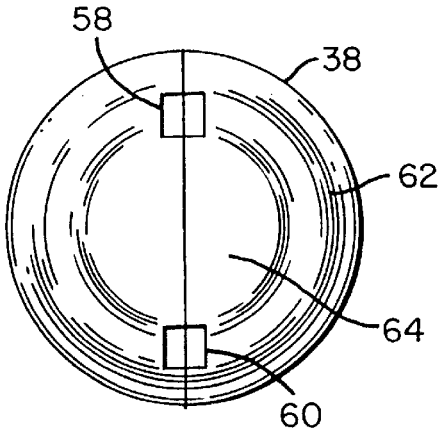
FIG. 2 is a bottom view of the wellbore cleaning tool.
Figure 3:
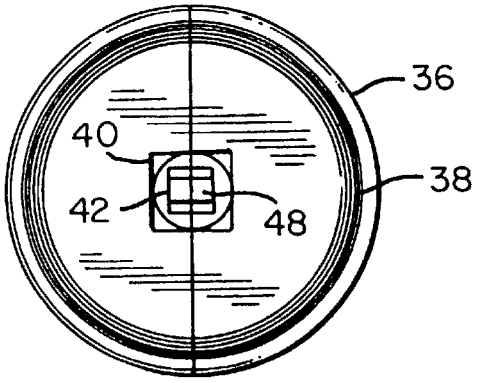
FIG. 3 is a top view thereof.
Figure 4:
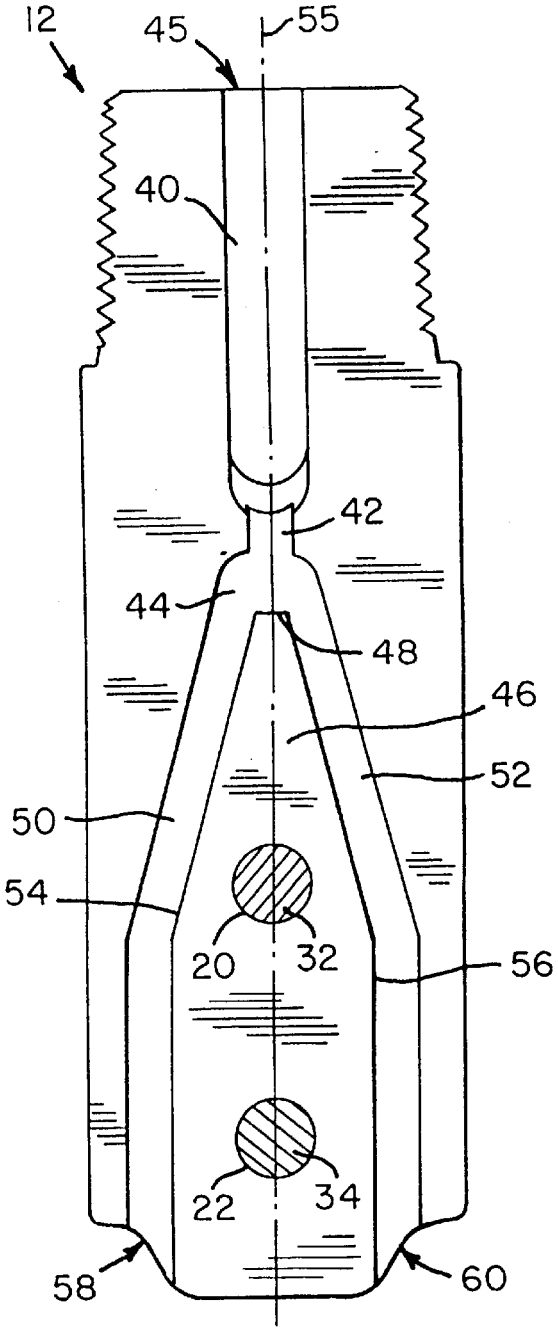
FIG. 4 is a cross-sectional view taken along line 4—4 of FIG. 1.

Referring now to the FIGS., a wellbore cleaning tool in accordance with the present invention is shown at 10. The tool 10 is constructed from two, semi-cylindrical portions 12 and 14 joined face-to-face by means of socket-head cap screws 16 and 18. The portion 12 is provided with a pair of vertically-spaced bores 20 and 22 which have been countersunk so that the heads 24 and 26 of the screws 16 and 18 will not project outwardly from the peripheral surface of the tool 10. The portion 14, on the other hand, is provided with a pair of threaded bores 28 and 30 which are axially aligned with the bores 20 and 22 and dimensioned to receive the threaded portions 32 and 34 of the screws 16 and 18.

With the portions 12 and 14 joined together, the tool 10 is provided with a body 36 of relatively large diameter having, at its upper end, a tapered, externally-threaded pin 38 adapted to be screwed into the end of a fluid supply conduit (not shown). A fluid entry channel 40 passes downwardly from a fluid entry port 45 through the pin 38 to a narrowed channel or nozzle 42 in the body 36. The nozzle 42 opens downwardly into a chamber 44 which is located above a flow divider 46 having a narrow edge 48 at its upper end. Fluid discharge channels 50 and 52, communicating with the chamber 44, extend downwardly along the side walls 54 and 56 of the divider 46. The lower ends of the discharge channels 50 and 52 are parallel to the longitudinal axis 55 of the cylindrical body 36 and terminate in downwardly-directed, fluid discharge ports 58 and 60 in the lower end of the body 36.

The lower end of the body 36 preferably has a conical end wall 62 which tapers downwardly to a flat surface 64 oriented at right angles to the longitudinal axis 55 of the tool 10. Since the surface 64 is provided with a diameter substantially equal to the width of the divider 46 at its lower end, the discharge ports 58 and 60 are located in the conical end wall 62. With this configuration, the discharge ports 58 and 60 cannot be blocked if the tool 10 is lowered onto a large obstruction in a wellbore during use.

It should also be noted that the conical end wall 62 also has a concave shape when viewed from the side. This shape is believed to assist in generating and maintaining fluid vortices in a wellbore by allowing wellbore fluids to steadily mix with the fluid discharged from ports 58 and 60. The fluid vortices generated as a desirable result of this mixing may "roll" against the lower end of the tool 10 without impedance as fluids are discharged from ports 58 and 60.

The tool 10 is normally used by screwing such into the end of a fluid supply conduit, such as a string of tubing, and then lowering the conduit and tool into a wellbore. When the tool 10 is lowered to a depth where cleaning is to begin, a fluid is pumped through the conduit to the tool. This fluid typically comprises a liquid, like brine or fresh water, but may also comprise a gas such as nitrogen. When a liquid is employed as a cleaning fluid, it is pumped at a preferred rate ranging from about 0.75 to 6.0 barrels per minute.

Upon reaching the tool 10, the cleaning fluid travels through the entry port 40 to the nozzle 42 where it accelerates and passes into the chamber 44 at a relatively high velocity. When cleaning fluid is delivered to the chamber 44 within the range of flow rates noted above, the flow of the cleaning fluid tends to be split in half by the divider 46 so that substantially equal volumes of fluid per unit of time are delivered to each of the channels 50 and 52 for discharge from ports 58 and 60.

When the discharge from the nozzle 42 strikes the narrow edge 48 at the upper end of the divider 46, vortices are created in the fluid at the upper ends of the channels 50 and 52. These vortices move with the fluid through the channels 50 and 52 and out the ports 58 and 60. Once outside the tool 10, the vortices travel downwardly through fluid already present in the wellbore to generate additional vortices and strike against the nearby well casing and perforations which extend through such casing.

The pressure fluctuations or "shock waves" generated by the vortices in the wellbore fluid are useful in removing foreign matter from the well casing and perforations. The pressure fluctuations deliver varying loads to any material that may be clinging to the casing or blocking its perforations. As a result, the material is disintegrated and flushed out of the top of the wellbore. After the cleaning operation is completed, the tool 10 is removed from the wellbore for reuse.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A wellbore cleaning tool, comprising:

an elongated, cylindrical body having an upper end that is threaded for attachment to a fluid supply conduit and a lower end that is circumferentially tapered and terminates in a narrowed, planar surface;

a fluid entry channel in the upper end of said cylindrical body; and, a pair of fluid discharge channels in communication with said fluid entry channel, each of said discharge channels having a discharge port positioned in said lower end of said cylindrical body adjacent said narrowed, planar surface.

2. The wellbore cleaning tool according to claim 1 further comprising a flow restricting nozzle adjacent the junction of said fluid discharge channels with said fluid entry channel.

3. The wellbore cleaning tool according to claim 1 wherein the upper end of said cylindrical body is externally threaded.

4. The wellbore cleaning tool according to claim 1 wherein said narrowed planar surface is orthogonal to the longitudinal axis of said cylindrical body.

5. The wellbore cleaning tool according to claim 1 wherein said fluid discharge channels are aligned with the longitudinal axis of said cylindrical body.

6. The wellbore cleaning tool according to claim 1 wherein said lower end of said cylindrical body is a conical surface.

7. The wellbore cleaning tool according to claim 6 wherein said conical surface is concave.

8. A wellbore cleaning tool, comprising:

an elongated, cylindrical body having an externally threaded pin at its upper end for attachment to a fluid supply conduit, said cylindrical body also having a conical, transition surface at its lower end that terminates in a narrowed, flat surface oriented orthogonally to the longitudinal axis of said cylindrical body;

a fluid entry channel in the upper end of said cylindrical body, the lower end of said fluid entry channel being reduced to form a nozzle;

a fluid flow divider having a leading edge surface that is aligned with said nozzle; and, a pair of fluid discharge channels on the opposite sides of said fluid flow divider and in communication with said nozzle, each of said fluid discharge channels having a fluid discharge port positioned in said conical, transition surface at the lower end of said cylindrical body.

9. The wellbore cleaning tool according to claim 8 wherein the lower ends of said fluid discharge channels are aligned with the longitudinal axis of said cylindrical body.

10. The wellbore cleaning tool according to claim 8 wherein said cylindrical body includes a pair of semi-cylindrical portions adapted to be joined together along the longitudinal axis of said cylindrical body, one of said semi-cylindrical portions having a first pair of bores, said first pair of bores intersecting said fluid flow divider and being countersunk to receive the heads of screws, the other one of said semi-cylindrical portions having a second pair of bores that are axially aligned with said first pair of bores, and said second pair of bores being threaded and adapted to threadably receive the threaded portions of screws whose heads are received within said first pair of bores.

11. The wellbore cleaning tool according to claim 10 wherein said fluid entry channel and said fluid discharge channels are defined by grooves formed in at least one of said semi-cylindrical portions.

12. The wellbore cleaning tool according to claim 10 wherein said fluid entry channel and said fluid discharge channels are defined by grooves formed in both of said semi-cylindrical portions.

13. A wellbore cleaning tool, comprising:

a pair of semi-cylindrical portions adapted to be joined together so as to form an elongated, cylindrical body having an externally threaded pin at its upper end for attachment to a fluid supply conduit and also having a conical, transition surface at its lower end that terminates in a narrowed, flat surface oriented orthogonally to the longitudinal axis of said cylindrical body, one of said semi-cylindrical portions having a pair of countersunk bores, the other one of said semi-cylindrical portions having a pair of threaded bores that are axially aligned with said countersunk bores;

a pair of screws, each positioned in an aligned pair of countersunk and threaded bores, for fastening said semi-cylindrical portions together;

a fluid entry channel in the upper end of said cylindrical body, the lower end of said fluid entry channel being reduced to form a nozzle;

a fluid flow divider having a leading edge surface that is aligned with said nozzle; and, a pair of fluid discharge channels on the opposite sides of said fluid flow divider and in communication with said nozzle, each of said fluid discharge channels having a fluid discharge port positioned in said conical, transition surface at the lower end of said cylindrical body.

14. The wellbore cleaning tool according to claim 13 wherein the lower ends of said fluid discharge channels are aligned with the longitudinal axis of said cylindrical body.

15. The wellbore cleaning tool according to claim 13 wherein said fluid entry channel and said fluid discharge channels are defined by grooves formed in at least one of said semi-cylindrical portions.

16. The wellbore cleaning tool according to claim 13 wherein said fluid entry channel and said fluid discharge channels are defined by grooves formed in both of said semi-cylindrical portions.

* * * * *